US006532851B2

(12) United States Patent
Moss et al.

(10) Patent No.: US 6,532,851 B2
(45) Date of Patent: Mar. 18, 2003

(54) APPARATUS FOR SUPPORTING PRODUCT DURING CUTTING

(75) Inventors: Richard J. Moss, Green Bay, WI (US); Larry D. Wierschke, Green Bay, WI (US)

(73) Assignee: Paper Converting Machine Company, Green Bay, WI (US)

( * ) Notice: Subject to any disclaimer, the term of this patent is extended or adjusted under 35 U.S.C. 154(b) by 0 days.

(21) Appl. No.: 09/746,961

(22) Filed: Dec. 21, 2000

(65) Prior Publication Data

US 2002/0078811 A1 Jun. 27, 2002

(51) Int. Cl.[7] ..... B26D 7/04

(52) U.S. Cl. ..... 83/466; 83/465; 83/457; 83/459; 83/466.1; 83/650

(58) Field of Search ..... 83/465, 466, 459, 83/457, 466.1, 649, 650

(56) References Cited

U.S. PATENT DOCUMENTS

| | | | | | |
|---|---|---|---|---|---|
| 490,179 | A | * | 1/1893 | Van Mater | 83/465 X |
| 757,770 | A | * | 4/1904 | Richter | 83/466 X |
| 1,946,390 | A | * | 2/1934 | Christiansen | 83/465 X |
| 3,066,564 | A | * | 12/1962 | Carpenter | 83/465 X |
| 3,107,564 | A | * | 10/1963 | Coker et al. | 83/465 X |
| RE25,718 | E | | 1/1965 | Barlament et al. | |
| 3,374,812 | A | * | 3/1968 | McManama | 83/466 |
| RE28,353 | E | | 3/1975 | Nystrand et al. | 242/527.1 |
| 4,031,788 | A | * | 6/1977 | Boge et al. | 83/465 X |
| 4,170,911 | A | * | 10/1979 | Ayers et al. | 83/466.1 X |
| RE30,598 | E | | 5/1981 | Spencer | 83/14 |
| 4,745,833 | A | * | 5/1988 | Davidson | 83/466 X |
| 5,038,647 | A | * | 8/1991 | Biagiotti | 83/466 X |
| 5,315,907 | A | | 5/1994 | Biagiotti | 83/38 |
| 5,357,833 | A | | 10/1994 | Biagiotti | 83/458 |
| 5,509,336 | A | | 4/1996 | Biagiotti | 83/461 |
| 5,647,259 | A | | 7/1997 | Biagiotti | 83/458 |
| 6,056,229 | A | | 5/2000 | Blume et al. | 242/521 |
| 6,123,002 | A | | 9/2000 | Wunderlich | 83/37 |

FOREIGN PATENT DOCUMENTS

| | | |
|---|---|---|
| EP | 0 526 412 A | 3/1993 |
| EP | 0 529 218 A | 3/1993 |
| EP | 0694020 B1 | 7/1997 |
| EP | 0 982 105 A | 3/2000 |

OTHER PUBLICATIONS

Patent Abstracts of Japan, vol. 2000, No. 21, Dated Apr. 24, 2001.

* cited by examiner

*Primary Examiner*—Charles Goodman

(57) ABSTRACT

An apparatus for supporting an elongated circular product during cutting includes a fixed lower support frame and a movable upper support frame. Right and left bottom support links include a lower end which is pivotally connected to the lower frame. Right and left side support links include a lower end which is slidably supported by a slot in the lower frame, an intermediate pivot point which is pivotally connected to the upper end of one of the bottom support links, and an upper end which is engageable with the product. The upper frame includes right and left guide surfaces which are engageable with the product. When the upper frame is moved downwardly toward the lower frame, the guide surfaces of the upper frame move the upper ends of the side support links closer to the center of the product.

11 Claims, 4 Drawing Sheets

APPARATUS FOR SUPPORTING PRODUCT DURING CUTTING

BACKGROUND

This invention relates to an apparatus for supporting product during cutting, and more particularly, to supporting product for cutting by a saw which transversely severs multi-ply material such as logs of bathroom tissue or kitchen toweling.

In the production of rolls of bathroom tissue or kitchen towels, a jumbo sized parent roll of web material is unwound, transversely perforated, and rewound into a log which has the diameter of the final product. The log is cut into individual rolls of bathroom tissue or kitchen towels by a log saw.

Rewinders are described, for example, in U.S. Pat. No. 6,056,229 and U.S. Pat. No. Re. 28,353 and EPO 0 694 020B1.

Log saws are described, for example, in U.S. Pat. No. 6,123,002, U.S. Pat. No. Re. 30,598, and U.S. Pat. No. 5,315,907.

In all present log saw assemblies, the log is advanced axially toward the path of the blade, which passes transversely through the log. The log is supported upstream of the blade, and the cut rolls plus the roll which is being cut are supported downstream of the blade.

The problems with current log saws vary depending upon the log saw. In some designs, as is shown in U.S. Pat. No. 5,315,907, the support is rigid, as is needed, but conforms to only one diameter of log for optimum cutting quality. This is also true of co-owned U.S. Pat. No. Re. 30,598. Change parts are required for handling large differences in product diameter.

In the assemblies shown in U.S. Pat. Nos. 5,357,833 and 5,647,259, the strips and straps that support the product are made flexible to allow adjustment for product diameter. These strips and straps have the elastic tendency to expand, in other words, straighten. Therefore, the strips and straps will seek a larger bending radius until forced to a smaller one, thereby not forming a true circle for the product.

The mechanism used for product diameter adjustment must be simple and make it easy for the person making the adjustment. In the assembly as shown in U.S. Pat. No. 5,357,833, two independent adjustments are required for variations in product diameter, one for the strap and the other for the oscillating cradles. Fine-tuning between them is required due to the elastic tendency of the strips and straps to expand.

In U.S. Pat. No. 5,647,259, which is an improvement over U.S. Pat. No. 5,357,833, a more complicated assembly was devised to achieve a coarse product diameter adjustment of the straps and cradles simultaneously with one drive. Based on the elastic tendency of the strips ard straps to expand, fine tuning, which is actually a second adjustment, is required to accommodate products of different diameters.

SUMMARY OF THE INVENTION

The converting industry is in need of an assembly that is not only rigid, but that provides sufficient contact with, or guiding for, the product throughout the full diameter range of the product. The apparatus used to achieve this should involve a single mode of adjustment. To solve this problem, a novel type of support assembly was invented, utilizing pivotable lower links, on which the product rides, guided by the components of the movable upper supporting assembly during adjustment for diameter variations. The invention provides an apparatus for an adjustable supporting assembly for the cutting of logs throughout an entire diameter range by way of a single adjustment mechanism, without the changing of any components or secondary fine tuning.

The invention includes two product support assemblies, one upstream and one downstream of the blade path. The support assemblies can be set up for single or multiple lanes of product. Each support assembly includes non-adjustable stationary guides above the product. The guides are formed so as to support product through a portion of the diameter range. The shape of these guides also controls the position of the links of a pivotable lower supporting assembly during adjustment for various product diameters. As the upper support assembly is raised, the links move to provide a larger opening through which the product moves. As the upper assembly is lowered, a smaller opening is provided. Raising and lowering of the upper support assembly can be done manually or by power.

DESCRIPTION OF THE DRAWING

The invention will be explained in conjunction with illustrative embodiments shown in the accompanying drawing, in which.

DESCRIPTION OF SPECIFIC EMBODIMENT

Figure 1:
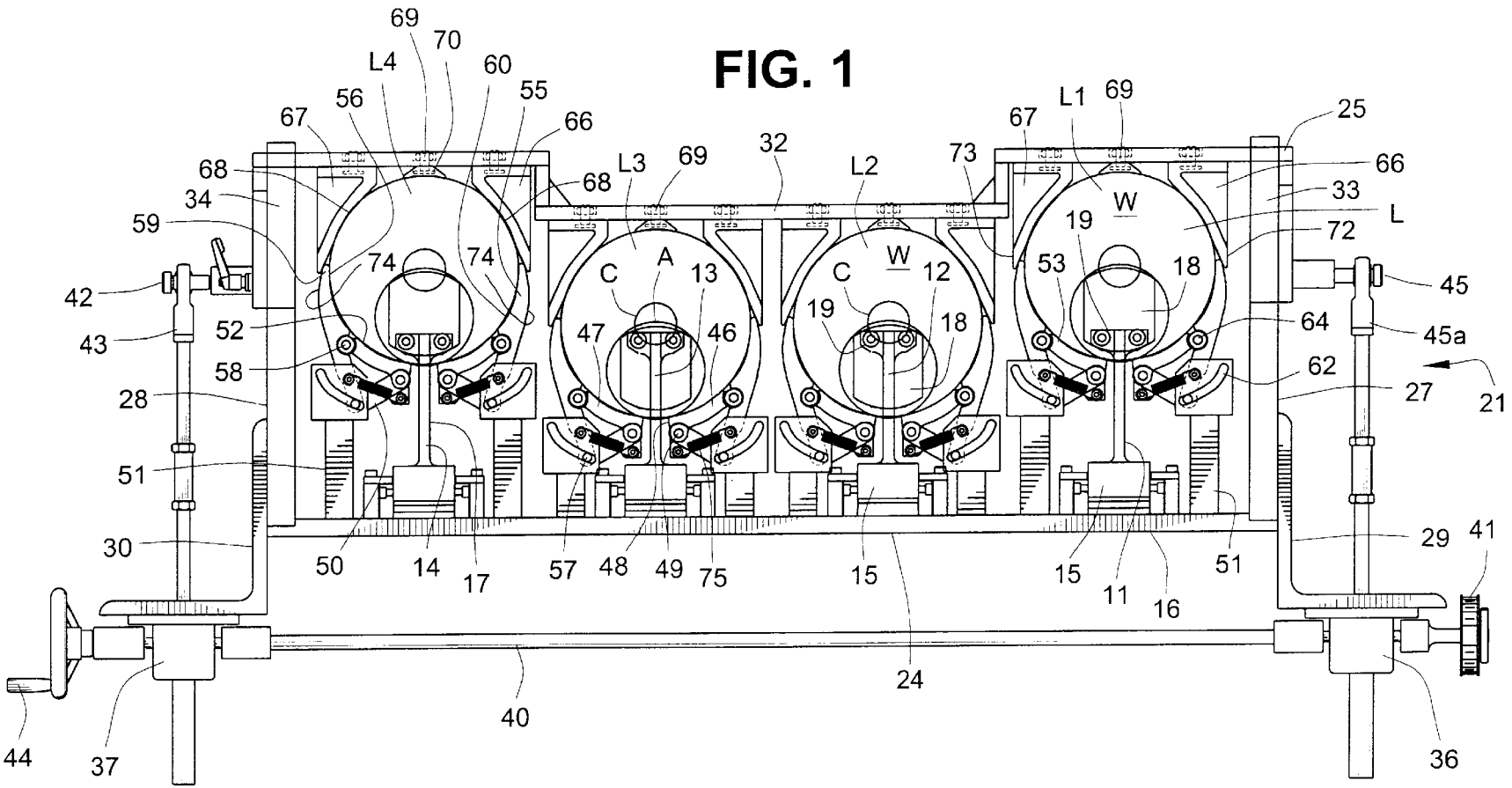
FIG. 1 is an end elevational view of a product support assembly formed in accordance with the invention, the assembly being adjusted for use with large diameter logs.

Logs L are removed axially toward a blade path P (FIG. 3) of a log saw by log pushers 11, 12, 13, and 14. The log pushers are conventional and well known in the log saw art. The particular log saw illustrated is a four lane saw, and four logs $L_1$, $L_2$, $L_3$, and $L_4$ are cut during each pass of the blade. However, the invention can be used with greater or fewer lanes. Each log includes a hollow core C and convolutely wound web material W.

The pushers are driven by conveyors 15 which are mounted on the support plate 16 of the log saw below the logs. Each pusher includes a vertical arm 17 and a paddle 18 which is attached to a bracket 19 on the upper end of the arm. The paddles of the pushers 11 and 14 extend upwardly from the bracket, and the paddles of the pushers 12 and 13 extend downwardly from the bracket.

Upstream and downstream product support assemblies 21 and 22 are mounted on the support plate 16 of the log saw upstream and downstream of the blade path P. The upstream and downstream assemblies are substantially identical, and only the upstream assembly will be described.

Each of the product support assemblies includes a lower product support frame 24 which is fixed to the support plate 16 and a movable upper product support frame 25 which is mounted on the support plate for vertical movement.

The lower frame 24 includes vertically extending side posts 27 and 28 which are attached to support plate 16. Right and left brackets 29 and 30 extend downwardly from the side posts. The upper frame 25 includes a top plate 32 and right and left sleeves 33 and 34 which are slidably mounted on the side posts 27 and 28.

Figure 3:
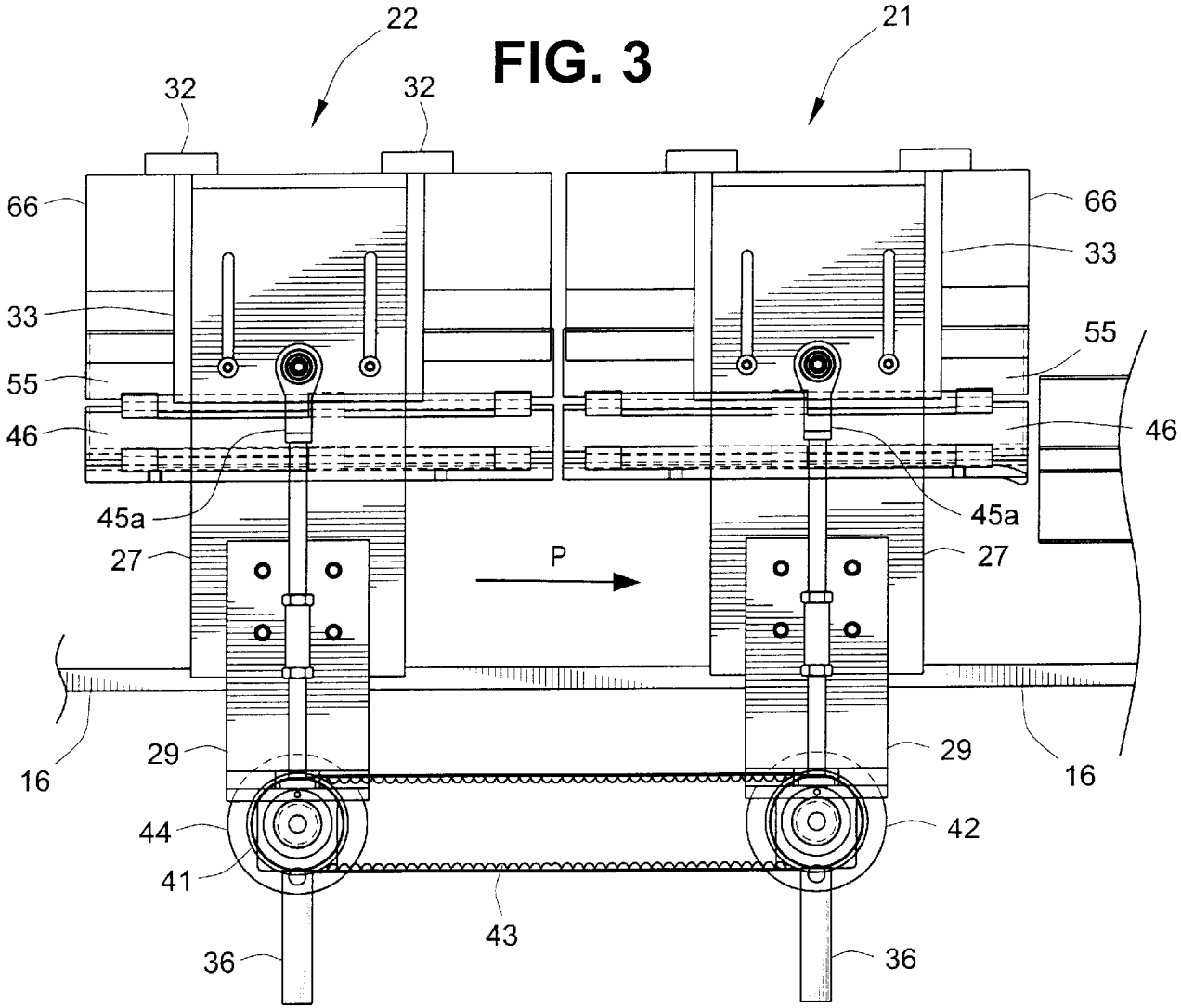
FIG. 3 is a side elevational view of the upstream and downstream product support assemblies.
Figure 4:
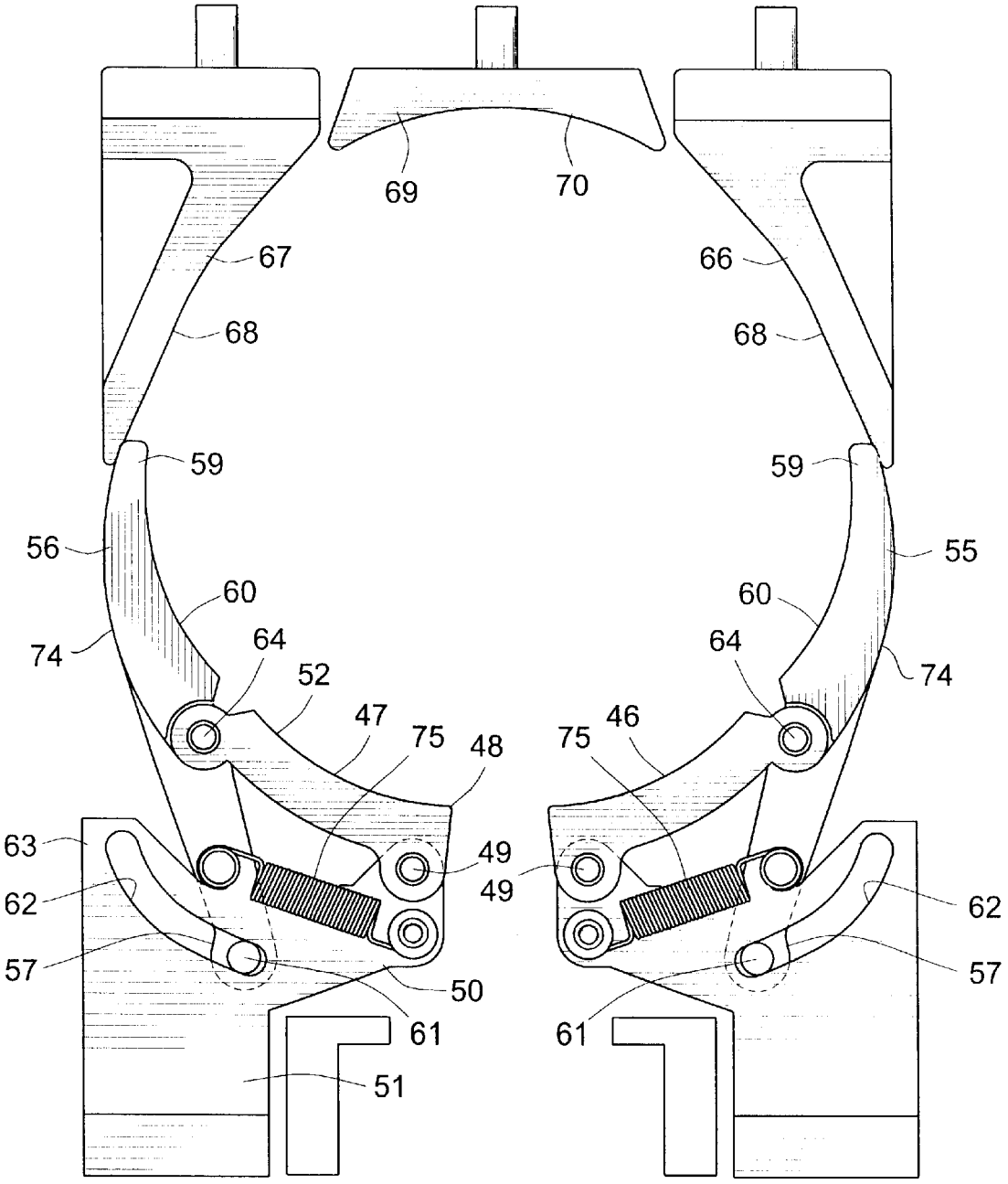
FIG. 4 is an enlarged end view of one of the product support assemblies.

The upper frame can be moved vertically by screw jacks 36 and 37 which are attached to brackets 29 and 30. The preferred screw jacks are available under the name Jacuator from Duff-Norton, P.O. Box 7010, Charlotte, N.C. 28241-7010. The screw jacks 36 and 37 are connected together by shaft 40. Referring to FIG. 3, the upstream and downstream screw jacks are connected by pulleys 41 and 42 and belt 43. The screw jacks are driven by a handwheel 44. Alternatively, the screw jacks can be driven by a motor. The upper ends of the screw jacks 36 and 37 are attached to the sleeves 33 and 34 by pins 45 which extend through eye brackets 45*a*.

A pair of right and left bottom log-supporting links 46 and 47 that support the log are pivotally mounted on the lower frame 24 for each of the four lanes of logs. Each link includes a lower end 48 which is pivotally connected by a pin 49 to a fixed bracket 50. The bracket 50 is mounted on a post 51 which is attached to the lower frame. Each of the links 46 and 47 also includes a log-supporting surface 52 which supports the bottom of the log L and an upper end 53.

Each lane also includes right and left side log-supporting links 55 and 56. Each of the side links includes a lower end 57, an intermediate pivot point 58, an upper end 59, and a log-supporting surface 60 which supports the side of the log. A pin 61 on the lower end of each side link is slidably mounted in a curved slot 62 in a plate 63 which is mounted on one of the posts 51. The intermediate pivot point 58 is pivotally connected by a pin 64 to the upper end of one of the bottom links 46 and 47.

A pair of right and left top product guides 66 and 67 are mounted oh the upper frame 25 for each log. Each guide includes a guiding and log-supporting surface 68. A center top product guide 69 is mounted on the upper frame between the guides 66 and 67 and includes a guide surface 70.

Referring to FIG. 1, when the upper frame 25 is in its raised position, the lower ends 72 and 73 of the top guides 66 and 67 engage the outside surface 74 of one of side links 55 and 56. A tension spring 75 is mounted on each post 51 and resiliently biases one of the side links outwardly into engagement with the associated top guide. If desired, the tension springs can be replaced by other mechanisms, such as properly positioned weights or a cable and weight. The requirement is to keep the outer surfaces 74 of the side links 55 and 56 against the top guides 66 and 67.

In FIG. 1 the guide surfaces of the bottom links 46 and 47, side links 55 and 56, and top guides 66, 67, and 69 circumscribe a substantially circular path. The circular outer surface of a relatively large diameter log is thereby supported over all or a substantial amount of its periphery. The links and the top guides are rigid and form rigid supporting surfaces for the log.

The right and left bottom links 46 and 47 are spaced on opposite sides of a vertical plane which extends through the axial centerline A of the log. The vertical arms 17 of the log pushers 14 can therefore pass between the links to push the log through the support assemblies.

For log saws for which the log is stationary during cutting, it is advantageous to set the diameter of the circle which is formed by the links and guides slightly less than the diameter of the log. The apparatus will thereby exert a clamping force on the log which will stop the log when the advancement of the log pushers stop.

For continuous motion saws of the type which are described in U.S. Pat. No. Re. 30,598 and U.S. Pat. No. 6,123,002, the log is advanced during cutting. The diameter of the supporting assembly can be either more or less than the diameter of the log.

When smaller logs are to be cut, the upper frame 25 is lowered toward the lower frame 24. The upper frame can be lowered manually by handwheel 44 or automatically by a motor which is connected to the screw jacks 36 and 37. As the upper frame moves downwardly, the guide surfaces of the top guides 66 and 67 cam the upper ends of the side links 55 and 56 inwardly toward the axis of the log. The lower ends of the side links are guided by the slots 62 and move outwardly and upwardly. The intermediate pivot points of the side links and the connected upper ends of the bottom links 46 and 47 move upwardly and inwardly. The substantially circular path which is formed by the bottom links, side links, and top guides thereby becomes smaller and is adjusted for smaller logs.

Figure 2:
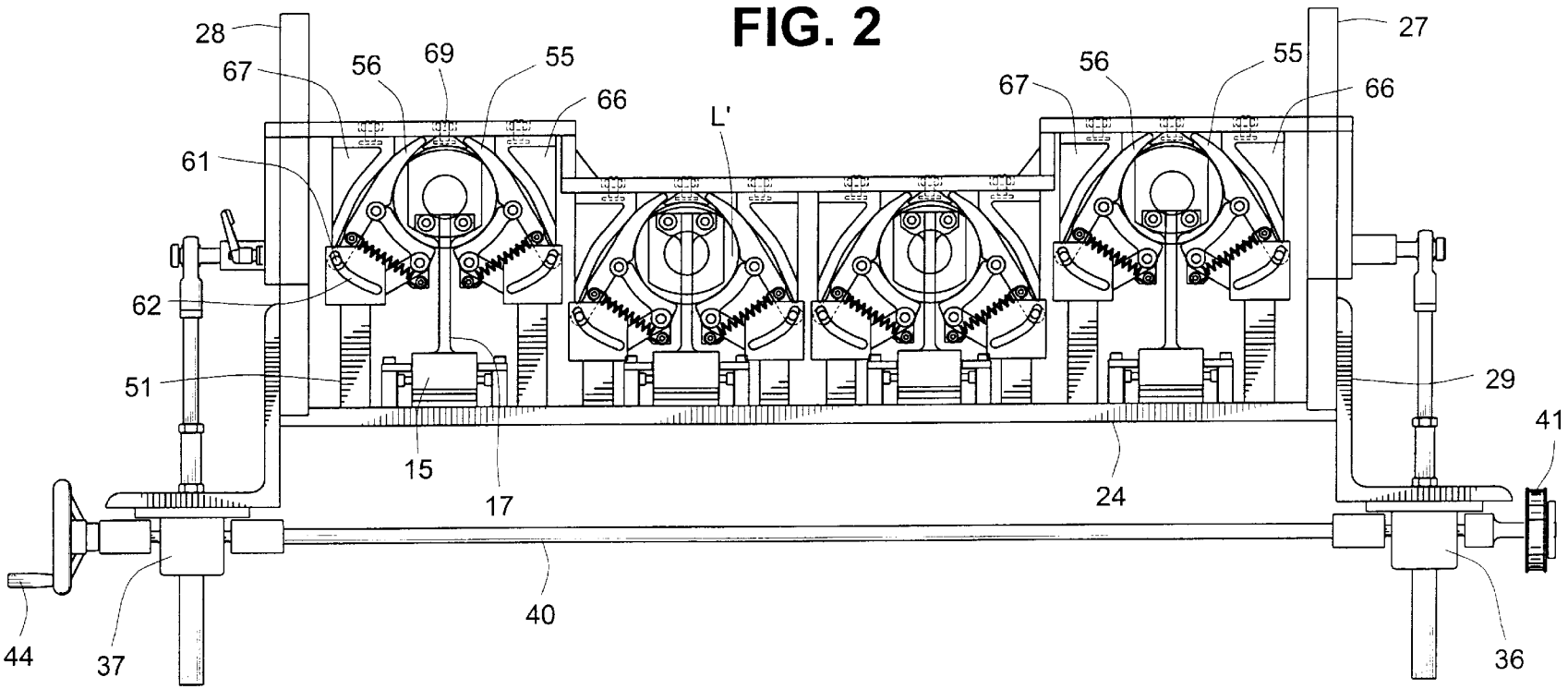
FIG. 2 is a view similar to FIG. 1 showing the assembly adjusted for use with small diameter logs.

FIG. 2 illustrates the upper frame in its fully lowered position. The lower ends of the side links are at the outer ends of the slots 62. The right bottom link 46 has been pivoted counterclockwise, and the left bottom link 47 has been pivoted clockwise.

The circular outer surface of a small diameter log L' is engaged around a substantial portion thereof by the guide surfaces of the bottom links 46 and 47, side links 55 and 56, and center top guide 69. Those surfaces do not form a perfect circle, but the surfaces still support a major portion of the circular outer surface of the log.

The size of the support assemblies can be increased by raising the upper frame 25. The tension springs 75 force the outer surfaces of the side links 55 and 56 against the guide surfaces of the top guides 66 and 67 so that the upper ends of the side links move outwardly as the upper frame is raised.

In the embodiment illustrated, the size of the support assemblies can be adjusted to accommodate log diameters within the range of 3.50 inches (88.9 mm) to 6.75 inches (171.5 mm) without changing parts. The adjustment throughout that range is accomplished by the single adjustment mechanism of raising or lowering the upper frame without any fine tuning.

The lower frame 24 remains stationary throughout the range of adjustment. The lower frame supports the pushers and the bottom links. The bottom links support the bottom of the log, and the support for the bottom of the log is therefore not repositioned for different sizes of logs. The support for the bottom of the log always remains in alignment with the log conveyor of the log saw, and there is no need to adjust the position of the support assemblies relative to the conveyor.

The curved outline which is formed by the guide surfaces of the bottom links, side links, and top guides is circular or substantially circular for at least one of the log diameters within the range of diameters which can be accommodated. It may be desirable to configure the guide surfaces to form a circular outline for a particular log diameter, depending upon which diameter will be used most. The curved outline of the guide surfaces at other diameters will not be precisely circular, but will be substantially circular.

In the preferred embodiment the guide surfaces of the bottom links, side links, and top guides directly contact the curved surface of the log. However, the benefits of the invention can still be achieved by interposing one or more intermediate members between the links and guides and the log. For example, a curved sleeve which substantially surrounds the log can be positioned between the links and guides and the log. In that event, the surfaces of the links and guides which contact the sleeve do not need to be curved. The links and guides still act as guides for the log by supporting the sleeve.

The intermediate member could also be two resilient pieces, one on each side of the log pusher and retained near the lower end 48 of the bottom link 46 or 47. The upper end of each piece would be free to move as the upper frame is adjusted for diameter change in a manner similar to that described in U.S. Pat. Nos. 5,357,833 and 5,647,259.

While in the foregoing specification a detailed description of a specific embodiment was set forth for the purpose of illustration, it will be understood that many of the details herein given may be varied considerably by those skilled in the art without departing from the spirit and scope of the invention.

We claim:

1. An apparatus for guiding an elongated product having a generally circular cross section and an axially extending centerline during cutting comprising:

a lower support frame, an upper support frame movably mounted with respect to the lower support frame, right and left bottom support links, each of the bottom support links having a lower and pivotally connected to the lower support frame, an upper end, and a guide surface adapted to guide the product, right and left side support links, each of the side support links having a lower end slidably supported by the lower support frame, an intermediate pivot point which is pivotally connected to the upper end of one of the bottom support links, an upper end, and a guide surface between the intermediate pivot point and the upper end of the support link adapted to guide the product, a top product guide mounted on the upper support frame, the top product guide having a guide surface adapted to guide the product, a right lower end engaging the right side support link, and a left lower end engaging the left side support link, the top product guide being movable with the upper support frame between a raised position in which the upper end of each of the side support links is spaced a first distance from the centerline of the product and a lowered position in which the upper end of each of the side support links is moved by the lower ends of the top product guide to a second distance from the centerline of the product which is less than said first distance.

2. The apparatus of claim 1 in which said surfaces of the bottom support links and the side support links are curved.

3. The apparatus of claim 2 in which said guide surface of the top product guide is curved.

4. The apparatus of claim 1 in which said guide surface of the top product guide is curved.

5. The apparatus of claim 1 in which said guide surface of the top product guide includes a right guide surface which includes said right lower end, a left guide surface which includes said left lower end, and a center guide surface between the right and left guide surfaces.

6. The apparatus of claim 5 in which said right, left and center guide surfaces are curved.

7. The apparatus of claim 1 including a spring engaging each of the side support links and resiliently biasing the side support links away from the centerline of the product.

8. The apparatus of claim 1 in which the lower end of each of the right and left side support links is slidably supported by a slot in the lower support frame.

9. The apparatus of claim 8 in which each of the slots in the lower support frame extends upwardly and outwardly and includes a lower end and an upper end, the lower end of each of the side support links being positioned in the lower end of the associated slot when the upper ends of the side support links are at said first distance, the lower end of each of the side support links being positioned in the upper end of the associated slot when the upper ends of the side support links are at said second distance.

10. The apparatus of claim 1 in which the pivotal connection between the lower end of each of the bottom support links and the lower support frame is at a fixed position and the pivotal connection between the upper end of each of the bottom support links and the associated side support link is movable as the side support links are moved by the top product guide.

11. The apparatus of claim 1 in which the upper end of each of the bottom support links is spaced a third distance from the centerline of the product when the upper ends of the side support links are at said first distance and are spaced a fourth distance from the centerline of the product when the upper ends of the side support links are at said second distance, said fourth distance of the bottom support links being less than the said third distance of the bottom support links.

* * * * *